US009731329B2

(12) United States Patent
Millan

(10) Patent No.: US 9,731,329 B2
(45) Date of Patent: Aug. 15, 2017

(54) METHODS FOR REMOVING INK FROM FILMS

(71) Applicant: Floral Packaging IP Holdings, LLC, Payson, UT (US)

(72) Inventor: Jorge Albeiro Millan, Bogota (CO)

(73) Assignee: Floral Packaging IP Holdings, LLC, Payson, UT (US)

( * ) Notice: Subject to any disclaimer, the term of this patent is extended or adjusted under 35 U.S.C. 154(b) by 511 days.

(21) Appl. No.: 14/163,857

(22) Filed: Jan. 24, 2014

(65) Prior Publication Data

US 2014/0174473 A1 Jun. 26, 2014

Related U.S. Application Data

(62) Division of application No. 13/725,817, filed on Dec. 21, 2012.

(51) Int. Cl.

| | |
|---|---|
| ***B08B 1/02*** | (2006.01) |
| *B08B 1/00* | (2006.01) |
| *B41M 7/00* | (2006.01) |

(52) U.S. Cl.

CPC ..... *B08B 1/02* (2013.01); *B08B 1/006* (2013.01); *B41M 7/0009* (2013.01)

(58) Field of Classification Search

CPC ... D21C 5/025; Y02W 30/648; B41M 7/0009; G03G 21/007; G03G 21/0076;

(Continued)

(56) References Cited

U.S. PATENT DOCUMENTS 1,858,437 A * 5/1932 Dufford ..... D21C 5/025 134/29

1,953,352 A 4/1934 Kranich (Continued)

FOREIGN PATENT DOCUMENTS

DE 19646421 A1 5/1997
EP 1419829 5/2004

(Continued)

OTHER PUBLICATIONS

EP2511096—Machine Translation, Oct. 2012.*

(Continued)

*Primary Examiner* — Michael Kornakov
*Assistant Examiner* — Marc Lorenzi
(74) *Attorney, Agent, or Firm* — TraskBritt

(57) ABSTRACT

A method of removing ink from a film includes unrolling the film from a first roll, exposing the film to a cleaning composition, and scraping the cleaning composition from the film. The film and the cleaning composition pass adjacent a first nonabrasive cloth to spread the cleaning composition over a width of the film, and adjacent at least one additional nonabrasive cloth to scrub the ink from the film. The film may be polymeric, metallic, or a metalized polymer. A system includes a means for unrolling a film, at least one nozzle configured to expose the film to a cleaning composition, and a blade configured to scrape the cleaning composition from the film. The system also includes a first nonabrasive cloth configured to spread the cleaning composition over a width of the film, and at least one additional nonabrasive cloth configured to scrub the ink from the film.

18 Claims, 3 Drawing Sheets

(58) Field of Classification Search
CPC ... G03G 21/0082; B41F 23/002; B08B 1/006; B08B 1/02; B08B 3/022; B08B 3/041
USPC ..... 134/9
See application file for complete search history.

(56) References Cited

U.S. PATENT DOCUMENTS

| | | | | |
|---|---|---|---|---|
| 2,634,221 | A | 4/1953 | McAlpine et al. | |
| 3,310,062 | A | 3/1967 | Little | |
| 4,068,616 | A | 1/1978 | Baum et al. | |
| 5,289,774 | A | 3/1994 | Stanka | |
| 5,621,939 | A | 4/1997 | Yoshida et al. | |
| 5,935,883 | A | 8/1999 | Pike | |
| 6,022,423 | A | 2/2000 | Bhatia | |
| 6,231,679 | B1 | 5/2001 | Mandai et al. | |
| 6,592,659 | B1 * | 7/2003 | Terrazas | C08G 65/007 106/287.13 |
| 6,789,554 | B2 | 9/2004 | Koizumi | |
| 7,592,398 | B1 | 9/2009 | Rye et al. | |
| 2005/0044650 | A1 * | 3/2005 | Goldberg | A47L 13/20 15/229.1 |
| 2007/0151945 | A1 | 7/2007 | Miyamachi et al. | |
| 2007/0159517 | A1 | 7/2007 | Hashimoto et al. | |
| 2008/0210256 | A1 | 9/2008 | Kretschmer et al. | |
| 2010/0031463 | A1 * | 2/2010 | Adams | A47L 13/20 15/231 |
| 2010/0037410 | A1 * | 2/2010 | Tsuchiya | A47L 13/38 15/231 |
| 2013/0014783 | A1 * | 1/2013 | Wandres | B08B 1/006 134/9 |
| 2013/0047365 | A1 * | 2/2013 | Goldwasser | A47L 13/17 15/209.1 |

FOREIGN PATENT DOCUMENTS

| | | | | |
|---|---|---|---|---|
| EP | 1314808 | | 4/2006 | |
| EP | 2511096 | A1 | 10/2012 | |
| GB | 1603047 | | 5/1978 | |
| HU | EP 2511096 | A1 * | 10/2012 | B41F 23/002 |
| JP | 07084488 | A | 3/1995 | |
| JP | 07113191 | A | 5/1995 | |
| JP | 07331137 | A | 12/1995 | |
| JP | 09057226 | A | 3/1997 | |
| JP | 2001-015896 | A | 1/2001 | |
| JP | 2005279577 | A | 10/2005 | |
| KR | 1020110124080 | A | 11/2011 | |
| WO | 9509256 | | 4/1995 | |
| WO | 2006028263 | | 3/2006 | |

OTHER PUBLICATIONS

Office Action from copending Chinese Application No. 201380066534.8 dated Jul. 4, 2016, with English translation.
Office Action from copending Japanese Application No. 2015-548785 drafting date Jun. 23, 2016 with English translation.
International Search Report and Written Opinion for International Application PCT/IB2013/02769, mailed Apr. 22, 2014, 13 pages.
Office Action from copending Korean Application No. 10-2015-7019437dated Feb. 23, 2017, with English translation.
Extended European Search Report for Application No. 13865695.4 dated Aug. 30, 2016, 9 pages.

* cited by examiner

METHODS FOR REMOVING INK FROM FILMS

CROSS-REFERENCE TO RELATED APPLICATION

This application is a divisional of co-pending U.S. patent application Ser. No. 13/725,817, filed Dec. 21, 2012, the disclosure of which is hereby incorporated herein in its entirety by this reference.

FIELD

Embodiments of the present disclosure relate to chemical processing, such as the processing of films (e.g., polyethylene, polypropylene, polyvinyl chloride, aluminum, and other films) used for packaging or labeling.

BACKGROUND

Polymeric, metallic, and metalized polymeric films have various properties that make them useful as packaging or labeling materials. For example, such films may be lightweight, strong, impervious to liquids and gases, transparent, printable, foldable, fusible, and/or heat-shrinkable. Films are commonly formed into sheets and rolled for processing, transport, and storage.

Films may be printed with various inks to provide information, decoration, etc. For example, rolls of polymeric films may be printed by unrolling the film, subjecting the unrolled film to a corona treatment (surface modification by exposure to a low-temperature plasma), applying an ink to the treated film, and rolling the film to another roller. Printing typically occurs in high-speed printing machinery, which may be capable of processing 100 linear feet per minute of plastic film or more.

Errors in printing (e.g., typographical errors in labels, overruns, alignment errors, incorrect colors, etc.) can be costly because large quantities of film may be processed before an error is identified and printing is interrupted. Higher-speed printing equipment is desirable in the industry because it allows for higher outputs; but higher-speed printing may correspond to larger quantities of misprinted films when errors are made. Misprinted films are typically sold as scrap for a small fraction of the price of virgin film. Such films may be melted and recycled, but this process may be costly and environmentally problematic.

Various attempts have been made to develop methods of effectively removing ink from films. For example, European Patent Specification EP 1 414 829 A1, published May 19, 2004, and entitled "Procédé de recyclage de support d'impression imprimé de type film plastique et installation pour la mise en oeuvre dudit procédé," describes a de-inking process in which a plastic film is simultaneously or sequentially immersed in a detergent composition and scrubbed with brushes. International Patent Application Publication WO 95/09256, published Apr. 6, 1995, and entitled "Treatment of Surfaces by Corona Discharge," describes a surface-cleaning process that may be used for metallic sheets or foils. An electric discharge is used to remove grease or oils from such metallic films. International Patent Application Publication WO 2006/028263 A1, published Mar. 16, 2006, and entitled "Erasable Ink, Method of Erasing Image Including the Same, and Method of Recycling Recording Medium Using the Erasing Method," describes an erasable ink that may be printed onto a recording medium. The ink may be removed from the recording medium by exposure to an oxidizing gas, such as that generated by a corona discharge. The entire contents of each of these documents are hereby incorporated by reference.

BRIEF SUMMARY

Described is a method of removing ink from a film. The method includes unrolling the film from a first roll, exposing the film to a cleaning composition, and scraping the cleaning composition from the film. The method includes passing the film and the cleaning composition adjacent a first nonabrasive cloth to spread the cleaning composition over a width of the film, and passing the film and the cleaning composition adjacent at least one additional nonabrasive cloth to scrub the ink from the film before scraping the cleaning composition from the film.

A system for removing ink from a film includes a means for unrolling the film from a first roll, at least one nozzle configured to expose the film to a cleaning composition, and a blade configured to scrape the cleaning composition from the film. Such a system includes a first nonabrasive cloth configured to spread the cleaning composition over a width of the film, and at least one additional nonabrasive cloth configured to scrub the ink from the film before scraping the cleaning composition from the film. Such a system further typically includes means for rolling the film back into a roll after ink removal.

DETAILED DESCRIPTION

Processes and machines for removing ink from films, as disclosed herein, include unrolling the film from a first roll, exposing the film to a cleaning composition, scraping the cleaning composition from the film, and rolling the film onto a second roll. The process includes passing the film and the cleaning composition adjacent a first nonabrasive cloth and passing the film and the cleaning composition adjacent at least one additional nonabrasive cloth before scraping the cleaning composition from the film. The nonabrasive cloths spread the cleaning composition and/or scrub the ink and cleaning composition from the film.

As used herein, the term "film" means and includes a polymeric, metallic, or metalized polymeric material having a thickness of less than about 1 mm and a width of at least about 10 cm. Polymeric films that may be used in the processes disclosed herein include, for example, polyester (e.g., bi-axially oriented polyethylene terephthalate (BOPET)), polyethylene (e.g., high density polyethylene (HDPE), low density polyethylene (LDPE), or ethylene vinyl alcohol polyethylene resin (EVOH PE)), polypropylene (e.g., oriented polypropylene (OPP), bi-axially oriented polypropylene (BOPP) or cast polypropylene (CPP)), polyvinyl chloride (PVC), etc. Metallic films that may be used in the processes disclosed herein include, for example, aluminum, copper, or tin. Metalized polymer films that may be used in the processes disclosed herein include, for example, polymer films coated with a thin layer of metal (e.g., aluminum).

As used herein, the term "ink" means and includes an opaque or translucent material formulated to bond to a film. Inks include, for example, solvent-based inks, water-based inks, electron-beam-curing inks, ultraviolet-curing inks, and two-part inks.

Figure 1:
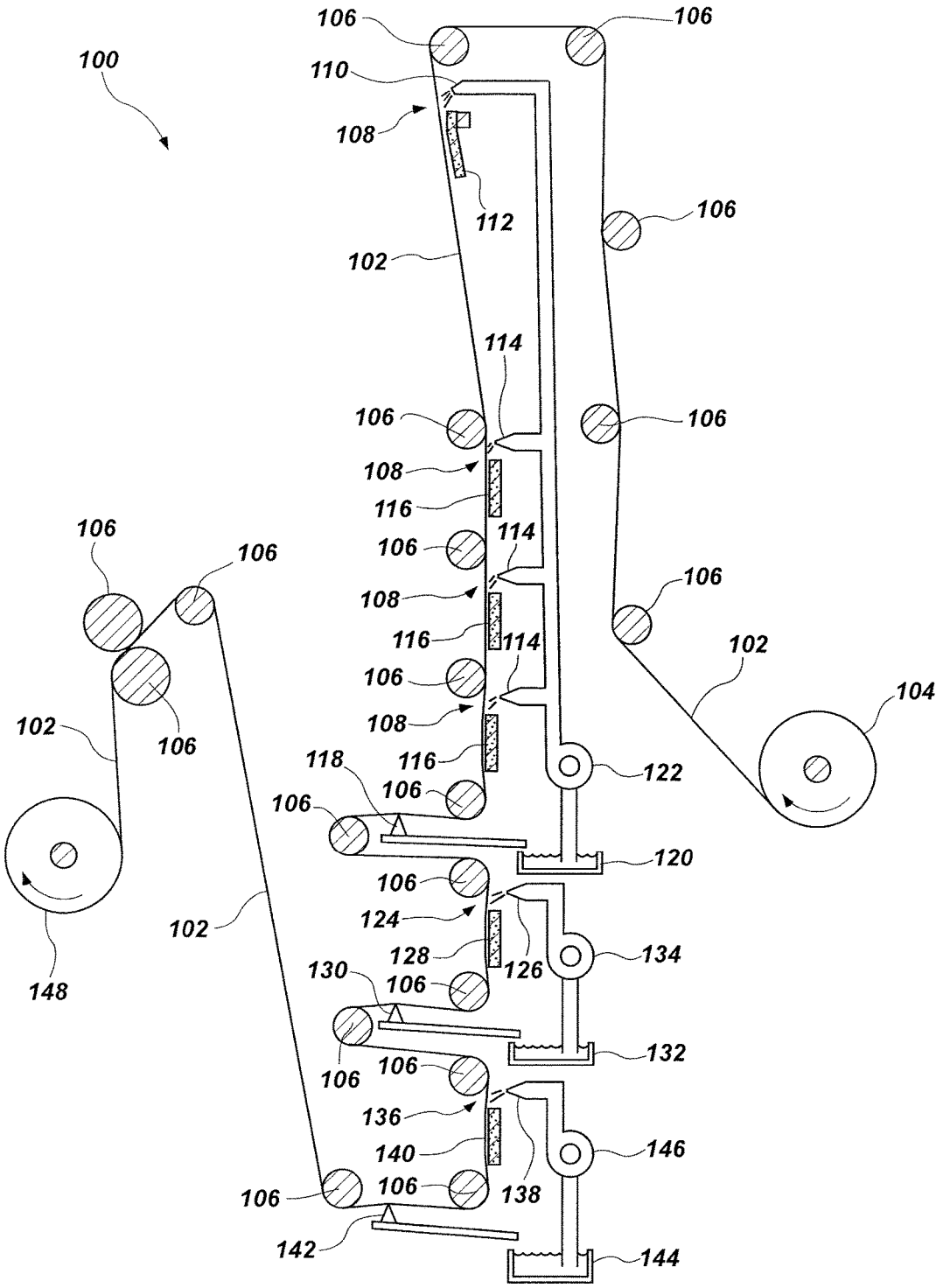
FIG. 1 is a simplified schematic illustrating a system and process for removing ink from a film.

A simplified (side view) schematic of a system 100 for removing ink from a film 102 is shown in FIG. 1, and the system 100 also illustrates a method of removing ink. In the system 100, the film 102 is unrolled from a first roll 104. The film 102 passes over, under, or between rollers 106, which are configured to allow the film 102 to continuously pass through the system 100 during the ink-removal process. The rollers 106 are also configured to direct the film 102 through the system 100 and to maintain tension on the film 102 while the film 102 is processed.

Figure 2:
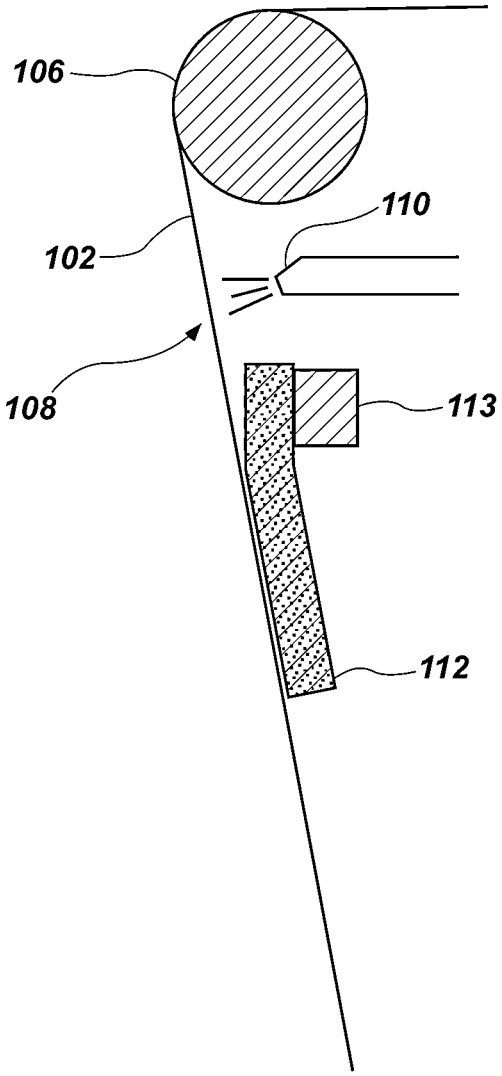
FIG. 2 is an enlarged detail view of a portion of FIG. 1.

As shown in FIG. 2, which is an enlarged detail view of a portion of FIG. 1, a cleaning composition 108 is applied to the film 102 through a first set of nozzles 110, typically after the film 102 has passed over, under, or between two or more rollers 106 to bring the film 102 to a location near the nozzles 110. The first set of nozzles 110 may include a row of nozzles evenly spaced across a width of the film 102, but may alternatively be a single channel opening adjacent to the film 102. The nozzles 110 may be formed of a material selected to avoid corrosion upon exposure to the cleaning composition 108, or may be coated with a material selected to avoid corrosion. For example, the nozzles 110 may be coated with polyurethane.

The cleaning composition 108 is spread across the width of the film 102 by a first nonabrasive cloth 112 or other soft material. The first nonabrasive cloth 112 may be disposed adjacent the nozzles 110, such that the cleaning composition 108 is spread across the film 102 almost immediately after application of the cleaning composition 108 to the film 102. For example, the first nonabrasive cloth 112 may be disposed within ten (10) cm of the nozzle(s) 110, within five (5) cm of the nozzle(s) 110, or even within one (1) cm of the nozzle(s) 110. The first nonabrasive cloth 112 may be secured to a support or brace 113 such that a V-shaped space or air gap is formed between an upper portion of the first nonabrasive cloth 112 and the film 102, but a lower portion of the first nonabrasive cloth 112 rests against the film 102 with a thin layer of cleaning composition 108 therebetween. After the film 102 passes the first nonabrasive cloth 112, the cleaning composition 108 may be spread approximately uniformly across a width of the film 102. The width across which the cleaning composition 108 is spread may be the entire width of the film 102, or may be only a portion of the width of the film 102. For example, there may be portions at each edge of the film 102 over which the cleaning composition 108 is not spread, such as portions of the film 102 that do not have ink or portions of the film 102 on which the ink should be retained. In some embodiments, a portion of the film 102 may remain uncoated with the cleaning composition 108 to limit or prevent contact of the cleaning composition 108 with the rollers 106.

The cleaning composition 108 may be a commercial or industrial cleaning composition having one or more of a surfactant, a terpene, water, a solvent, and an emulsifier. As used herein, the term "surfactant" means and includes a compound having both a hydrophobic group and a hydrophilic group. The surfactant may be an anionic, nonionic, cationic, amphoteric, or zwitterionic surfactant, or a combination thereof. Examples of surfactants include, but are not limited to, soaps, sulfonates, sulfates, carboxylates, phosphonates, phosphates, laurates, quaternary ammonium detergents, etc. In some embodiments, cleaning compositions including D-limonene may be used, such as those described in Great Britain Patent Specification 1 603 047, published Nov. 18, 1981, and entitled "Cleansers Containing D-Limonene," the entire contents of which are hereby incorporated by reference. The cleaning composition 108 may be selected to be free of abrasive material, which may limit or prevent scratching or tearing of the film 102 during the ink-removal process.

Figure 3:
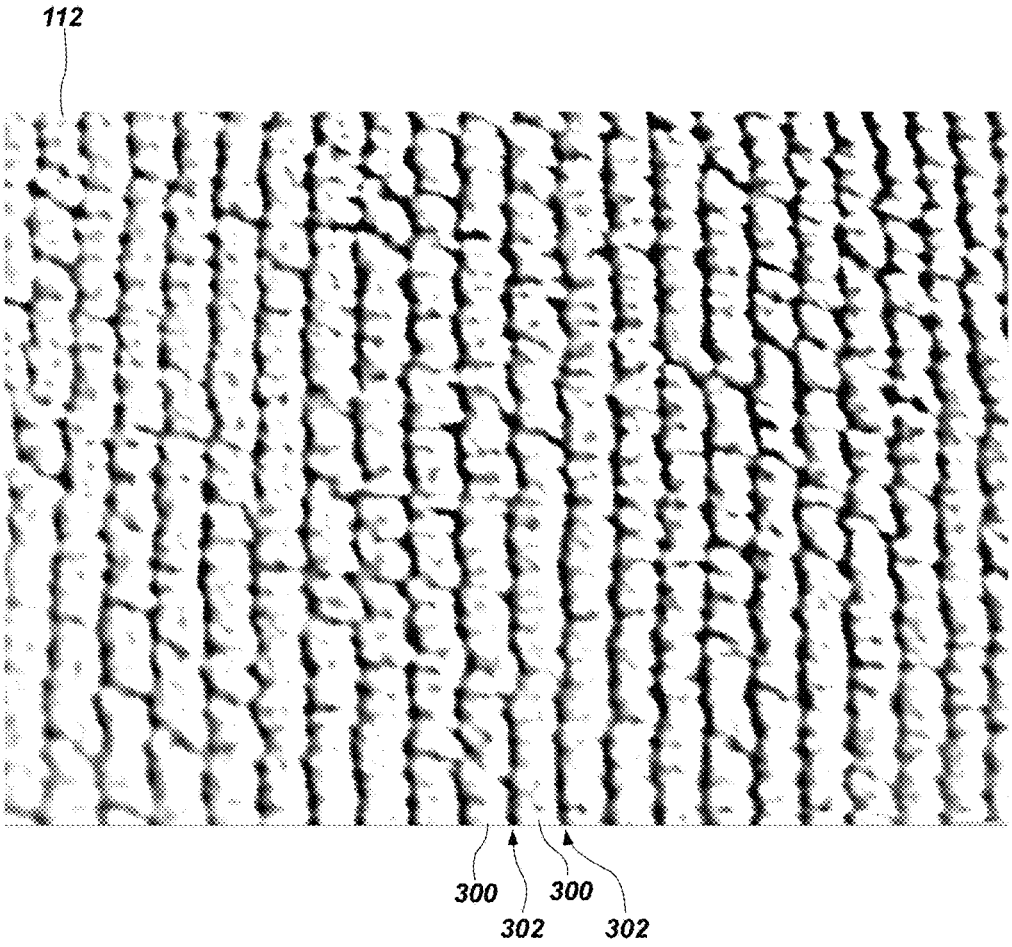
FIG. 3 shows a detail of a nonabrasive cloth of the system shown in FIG. 1.

The first nonabrasive cloth 112 is typically a woven microfiber cloth. The first nonabrasive cloth 112 may be selected to limit or prevent scratching or tearing of the film 102 during the ink-removal process. For example, FIG. 3 shows a detail of the first nonabrasive cloth 112. The first nonabrasive cloth 112 may have loops or threads of material arranged in rows 300 with spaces or voids 302 between the rows 300. The first nonabrasive cloth 112 may be oriented in the system 100 (FIG. 1) such that the rows 300 and the spaces or voids 302 form parallel channels oriented parallel to the direction of travel of the film 102. Thus, as the film 102 passes the first nonabrasive cloth 112, a portion of the cleaning composition 108 may travel adjacent the first nonabrasive cloth 112 through the spaces or voids 302. The rows 300 of material and the spaces or voids 302 of the first nonabrasive cloth 112, in such an orientation, tend to spread the cleaning composition 108 into a relatively uniform coating on the film 102. If the cleaning composition 108 is applied to the film 102 across the entire width of the first nonabrasive cloth 112, the cleaning composition 108 tends to cover the entire portion of the film 102 passing over the first nonabrasive cloth 112.

Returning to FIG. 1, the cleaning composition 108 may be applied to the film 102 at a location at which the film 102 is traveling downward. In such an arrangement, the cleaning composition 108 flows down the film 102, driven both by the motion of the film 102 and by the force of gravity. The speed of the film 102, the distance between the first nonabrasive cloth 112 and subsequent processing features, and the viscosity of the cleaning composition 108 may be selected such that the film 102 is exposed to the cleaning composition 108 for a selected period of time. For example, the film 102 may be exposed to the cleaning composition 108 for a time period from about 0.1 s (second) to about sixty (60) s, such as from about one (1) s to about ten (10) s. The ability of the cleaning composition 108 to remove ink may depend on the time of exposure of the film 102 to the cleaning composition 108.

After the initial exposure of the film 102 to the cleaning composition 108, additional cleaning composition 108 may be applied to the film 102 through an additional set of nozzles 114. The film 102 then passes adjacent to an additional nonabrasive cloth 116. The additional nonabrasive cloth 116 may be similar to the first nonabrasive cloth 112, described above, but may be disposed substantially parallel to the direction of travel of the film 102. For example, the additional nonabrasive cloth 116 may be wrapped partially around a block, and the film 102 may pass along a surface of the block. The additional nonabrasive cloth 116 scrubs ink from the film 102 as the film 102 passes the additional nonabrasive cloth 116.

Another portion of cleaning composition 108 (e.g., a third portion of cleaning composition 108) may be applied to the film 102 through another set of nozzles 114 (e.g., a third set of nozzles), which may be followed by another nonabrasive cloth 116. The sequence of cleaning composition 108 followed by a nonabrasive cloth 116 may be repeated as many times as necessary to sufficiently remove ink from the film 102. For example, and as shown in FIG. 1, the system may include four sets of nozzles 110, 114, and four nonabrasive cloths 112, 116. The first nonabrasive cloth 112 may be configured primarily to spread the cleaning composition 108, and the additional nonabrasive cloths 116 may be configured primarily to scrub ink from the film 102.

After scrubbing ink from the film 102, a blade 118 scrapes the cleaning composition 108 and dislodged ink material from the film 102 into a collection vessel 120. A pump 122 recycles the cleaning composition 108 back through the nozzles 110, 114. The collection vessel 120 or the pump 122 may include a means for separating ink material from the cleaning composition 108. For example, the collection vessel 120 may be large enough that ink material can settle from the cleaning composition 108 based on density. In some embodiments, the pump 122 may include a filter to remove ink material from the cleaning composition 108.

After scrubbing the film 102 with cleaning composition 108, the film 102 may be scrubbed again with another cleaning composition 124. The cleaning composition 124 is applied to the film 102 through a set of nozzles 126, followed by another nonabrasive cloth 128. The sequence of cleaning composition 124 followed by a nonabrasive cloth 128 may be repeated as many times as necessary to sufficiently remove ink from the film 102. For example, and as shown in FIG. 1, the system may include one set of nozzles 126, and one nonabrasive cloth 128.

Another blade 130 scrapes the cleaning composition 108 and dislodged ink material from the film 102 into a collection vessel 132. A pump 134 recycles the cleaning composition 124 back through the nozzles 126. The collection vessel 132 or the pump 134 may include means for separating ink material from the cleaning composition 124. For example, the collection vessel 132 may be large enough that ink material can settle from the cleaning composition 124 based on density. In some embodiments, the pump 134 may include a filter to remove ink material from the cleaning composition 124.

The cleaning composition 124 may be similar to the cleaning composition 108, as described above. Because the film 102 has already been scrubbed to remove some of the ink before cleaning composition 124 is applied, the cleaning composition 124 may be kept cleaner than the cleaning composition 108 used for initial cleaning. Therefore, after the system 100 has operated for a period of time, the cleaning composition 124 may used to replace all or a portion of the cleaning composition 108, and new cleaning composition (e.g., virgin cleaning composition or a cleaning composition that has been purified) may be used to replace the cleaning composition 124.

After scrubbing the film 102 with cleaning composition 124, the film 102 may be rinsed with a solvent 136, such as an alcohol, an ether, a chlorinated solvent, water, or any combination thereof. For example, the solvent 136 is typically a liquid and may include isopropyl alcohol, methanol, ethanol, water, and/or deionized water. The solvent 136 is applied to the film 102 through a set of nozzles 138, followed by another nonabrasive cloth 140. The sequence of solvent 136 followed by a nonabrasive cloth 140 may be repeated as many times as necessary to sufficiently remove ink and cleaning composition from the film 102. For example, and as shown in FIG. 1, the system may include one set of nozzles 138, and one nonabrasive cloth 140.

Another blade 142 scrapes the film 102 to remove the solvent 136, cleaning composition, and ink, which are collected in a collection vessel 144. A solvent pump 146 recycles the solvent 136 back through the nozzles 138. The collection vessel 144 or the solvent pump 146 may include a means for separating ink material and cleaning composition from the solvent 136. For example, the collection vessel 144 may be large enough that ink material and cleaning composition can settle from the solvent 136 based on density. In some embodiments, the solvent pump 146 may include a filter to remove ink material or cleaning composition from the solvent 136.

The solvent 136 may be selected to have a low boiling point, such that any solvent 136 remaining on the film 102 after the film 102 passes the blade 142 evaporates quickly at ambient temperatures. Thus, the film 102 may be dry or nearly dry after passing over the blade 142. After passing over the blade 142, the film 102 may be transferred to a second (motorized) roll 148 for reuse in a printing process. The second roll 148 may be transported to a storage location to a printing system, to a cutting system, etc.

The blades 118, 130, 142 exert a force uniformly across the width of the film 102, such that the ink, cleaning compositions 108, 124, and solvent 136 are removed from the film 102. The blades 118, 130, 142 may be formed of a polymeric or metal material, and may be formed by casting, pressing, molding, stamping, etc. The design of the blades 118, 130, 142 may be selected to achieve any selected stiffness to promote removal of the ink, cleaning compositions 108, 124, and solvent 136 from the film 102. The blades 118, 130, 142 may be selected to have a width approximately equal to the width of the film 102 to be cleaned. In some embodiments, the blades 118, 130, 142 may be formed of a molded polyurethane.

In some embodiments, the edges of the film 102 may retain ink material. For example, to avoid contamination of the rollers 106, the cleaning compositions 108, 124 may not be spread to the edges of the film 102 during the cleaning process. In such embodiments, a portion of one or both edged of the film 102 may be sliced after the cleaning process, such as by conventional slicing techniques known in the art. For example, approximately one (1) mm, two (2) mm, five (5) mm, ten (10) mm, or even twenty (20) mm of material may be sliced from each edge of the film 102.

In some embodiments, the system 100 may be coupled with a printing system, as known in the art and not described in detail herein, such that the system 100 provides a continuous supply of cleaned film 102 to the printing system. In such embodiments, the second roll 148 may optionally be omitted if the supply of film 102 to be passed through the system 100 is expected to consistently provide the needs of the printing system.

The system 100 includes sufficient rollers 106 to maintain tension on the film 102. The tension on the film 102 allows the nonabrasive cloths 112, 116, 128, 140 and the blades 118, 130, 142 to exert forces on the film 102. The tension may be varied to vary the amount of force on the film 102. For example, tension may be increased to clean heavily printed films, or may be decreased to clean relatively thin or weak films without breaking or tearing.

The system 100 also includes various controls, which are known in the art and not described in detail herein. For example, the system 100 may include motors, valves, springs, sensors, computer controls, etc. In some embodiments, portions of the system 100 may be enclosed, such as to collect a portion of vapor of the solvent 136 or to protect workers from moving parts or from hazardous materials.

The system 100 as shown and described is configured to remove ink from one side of a film 102. To clean ink from both sides of a film 102, the film 102 may be passed through the system 100 twice. Alternatively, a cleaning system may include additional nozzles, nonabrasive cloths, blades, rollers, etc. to remove ink from the opposite side before rolling the film 102 onto the second roll 148. The two sides of the film 102 may be cleaned sequentially (e.g., one side is substantially cleaned before the cleaning composition is applied to the other side) or simultaneously (e.g., the cleaning composition is applied to both sides concurrently).

EXAMPLE

A roll of clear bi-axially oriented polypropylene (BOPP) film having a width of about 1.0 m has a design printed one surface, such that about 75% of that surface has ink affixed thereto. The BOPP film is processed in a system such as the system 100 shown in FIG. 1. A cleaning solution including D-limonene and water is applied to the BOPP film, and is spread over substantially the entire width of the printed surface of the BOPP film by a microfiber cloth. The film travels downward approximately 1.5 m before additional cleaning solution is applied to the printed surface of the BOPP film. Continuing its downward path, the printed surface of the BOPP film passes a second microfiber cloth, which scrubs some of the ink from the BOPP film. Additional cleaning solution is applied to the printed surface of the BOPP film, and a third microfiber cloth scrubs more of the ink. Additional cleaning solution is applied to the printed surface of the BOPP film, and a fourth microfiber cloth scrubs still more of the ink from the BOPP film. The BOPP film travels horizontally after passing a roller, and the cleaning solution and dislodged ink are then removed from the BOPP film by a first polyurethane blade. The cleaning solution is separated from the ink and recycled.

The BOPP film travels vertically downward again, where another cleaning solution is applied to the BOPP film. A fifth microfiber cloth scrubs ink from the BOPP film. The BOPP film travels horizontally after passing a roller, and the cleaning solution and dislodged ink are then removed from the BOPP film by a second polyurethane blade. The cleaning solution is separated from the ink and recycled.

The BOPP film travels vertically downward again, where a solution of 70% isopropyl alcohol and 30% water is applied to the BOPP film. A sixth microfiber cloth scrubs the BOPP film. The BOPP film travels horizontally after passing a roller, and the solution of alcohol and water, remaining cleaning solution, and dislodged ink are removed from the BOPP film by a third polyurethane blade. The solution of alcohol and water is separated from the ink and recycled.

The BOPP film is rerolled for subsequent re-printing and reuse. The process removes substantially all the ink from the printed surface of the BOPP film, leaving a slight tint at the edges of the BOPP film, which is optionally removed by slicing. The BOPP film is substantially free of residue of the ink or the cleaning solution. By removing the ink from the BOPP film, the BOPP film may be suitable for reuse in packaging products, instead of recycled by melting the BOPP film. For example, the BOPP film may be clean enough for packaging food products.

Once being apprised of the instant disclosure, one of ordinary skill in the art will be able to make the system with readily commercially available components (e.g., motors, rolls, and nozzles).

What is claimed is:

1. A method of removing ink from a film, comprising:

unrolling the film from a first roll of film;

rolling the film over a roller;

exposing a first side of the film to a cleaning composition, the first side of the film printed with ink;

passing the first side of the film and the cleaning composition adjacent a first member comprising microfiber cloth having a plurality of parallel channels between adjacent rows of fibers to spread the cleaning composition over a width of the first side of the film, wherein each channel of the parallel channels extends in a direction parallel to a direction of travel of the film;

translating the cleaning composition on the first side of the film from the first member comprising cloth to at least one additional member comprising cloth;

passing the first side of the film and the cleaning composition adjacent the at least one additional member comprising cloth to excise the ink from the film; and separating the cleaning composition and the excised ink from the first side of the film after passing the first side of the film and the cleaning composition adjacent the at least one additional member comprising cloth.

2. The method of claim 1, wherein the translating the cleaning composition on the first side of the film comprises translating the cleaning composition downward.

3. The method of claim 1, further comprising exposing the first side of the film to additional cleaning composition before passing the first side of the film and the cleaning composition adjacent the at least one additional member comprising cloth.

4. The method of claim 1, wherein passing the first side of the film and the cleaning composition adjacent the at least one additional member comprising cloth comprises passing the first side of the film and the cleaning composition adjacent at least three additional members, each comprising cloth.

5. The method of claim 1, further comprising exposing the first side of the film to a solvent after passing the first side of the film and the cleaning composition adjacent the at least one additional member comprising cloth, the solvent comprising at least one of an alcohol, an ether, a chlorinated solvent, and water, the solvent having a different composition than the cleaning composition.

6. The method of claim 5, further comprising passing the first side of the film and the solvent adjacent a further member comprising cloth.

7. The method of claim 6, wherein exposing the first side of the film to a solvent after passing the first side of the film and the cleaning composition adjacent the at least one additional member comprising cloth comprises exposing the first side of the film to isopropyl alcohol.

8. The method of claim 1, wherein the film is a polymeric film.

9. The method of claim 1, wherein the film is a metal film.

10. The method of claim 1, wherein rolling the film over a roller comprises continuously passing the film to the first member comprising cloth.

11. A method of removing ink from a film, the method comprising:

unrolling a film from a first roll of film, wherein the film is selected from the group consisting of polyethylene, polypropylene, polyvinyl chloride, and aluminum film;

applying a cleaning composition to a first side of the film, the first side having ink thereon;

spreading the cleaning composition over a width of the first side of the film by passing the first side of the film adjacent a first member comprising microfiber cloth having a plurality of channels between adjacent rows of fibers, wherein each channel of the parallel channels extends in a direction parallel to a direction of travel of the film;

translating the cleaning composition along a path of the film;

dissociating ink from the first side of the film by passing the first side of the film and the cleaning composition adjacent at least one additional member comprising cloth; and separating the cleaning composition and the dissociated print from the first side of the film.

12. The method according to claim 11, further comprising applying a solvent to the first side of the film after separating the cleaning composition and the dissociated print from the first side of the film, the solvent comprising at least one solvent selected from the group consisting of an alcohol, an ether, a chlorinated solvent, and water.

13. The method according to claim 11, wherein applying a cleaning composition to a first side of the film comprises passing the cleaning composition through at least one nozzle.

14. The method according to claim 13, wherein the at least one nozzle comprises a polyurethane-coated nozzle.

15. The method according to claim 11, further comprising rolling the film onto a second roll of film after separating the cleaning composition and the dissociated ink from the first side of the film.

16. The method according to claim 11, further comprising after separating the cleaning composition and the dissociated ink from the first side of the film, reusing the film in a printing process.

17. The method according to claim 11, further comprising:

applying the cleaning composition to a second side of the film, the second side having ink thereon;

spreading the cleaning composition over a width of the second side of the film by passing the second side of the film adjacent a second member comprising cloth;

translating the cleaning composition along a path of the film;

dissociating ink from the second side of the film by passing the second side of the film and the cleaning composition adjacent at least one additional second member comprising cloth; and separating the cleaning composition and the dissociated ink from the second side of the film.

18. A method of removing ink from a film, the method comprising:

unrolling a film from a first roll of film, wherein the film is selected from the group consisting of polyethylene, polypropylene, polyvinyl chloride, and aluminum film;

applying a cleaning composition to a first side of the film;

spreading the cleaning composition over a width of the first side of the film by passing the first side of the film adjacent a first member comprising microfiber cloth having a plurality of channels between adjacent rows of fibers, wherein each channel of the parallel channels extends in a direction parallel to a direction of travel of the film;

translating the applied cleaning composition along a path of the film;

dissociating ink from the first side of the film by passing the first side of the film and the cleaning composition adjacent at least one second member comprising cloth;

separating the cleaning composition and the dissociated ink from the first side of the film;

applying a solvent to the first side of the film, the solvent comprising at least one solvent selected from the group consisting of an alcohol, an ether, a chlorinated solvent, and water;

spreading the solvent over a width of the first side of the film by passing the first side of the film adjacent a third member comprising cloth;

translating the applied solvent along a path of the film;

separating the solvent from the first side of the film;

applying water to the first side of the film;

spreading the applied water over a width of the first side of the film by passing the first side of the film adjacent a fourth member comprising cloth;

translating the water along a path of the film; and separating the water from the first side of the film.

* * * * *